US011371401B2

(12) United States Patent
Shimizu et al.

(10) Patent No.: US 11,371,401 B2
(45) Date of Patent: Jun. 28, 2022

(54) EXHAUST MUFFLER

(71) Applicant: HONDA MOTOR CO., LTD., Tokyo (JP)

(72) Inventors: Takahiko Shimizu, Wako (JP); Hiroshi Mahira, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 295 days.

(21) Appl. No.: 16/496,668

(22) PCT Filed: Mar. 27, 2017

(86) PCT No.: PCT/JP2017/012312
§ 371 (c)(1),
(2) Date: Sep. 23, 2019

(87) PCT Pub. No.: WO2018/179037
PCT Pub. Date: Oct. 4, 2018

(65) Prior Publication Data

US 2020/0318510 A1 Oct. 8, 2020

(51) Int. Cl.
*F01N 1/02* (2006.01)

(52) U.S. Cl.
CPC ..... *F01N 1/02* (2013.01); *F01N 2450/22* (2013.01); *F01N 2450/24* (2013.01);
(Continued)

(58) Field of Classification Search
CPC ... F01N 1/003; F01N 1/02; F01N 1/04; F01N 1/026; F01N 1/089; F01N 13/08; F01N 13/089; F01N 13/1805; F01N 13/1838; F01N 13/185; F01N 2470/02; F01N 2470/14; F01N 2470/20; F01N 2490/02;
(Continued)

(56) References Cited

U.S. PATENT DOCUMENTS 2,834,425 A * 5/1958 Rawson ..... F01N 13/185 181/252
5,979,583 A * 11/1999 Amino ..... F01N 1/08 180/219
(Continued)

FOREIGN PATENT DOCUMENTS

FR 1043396 A * 11/1953 ..... F01N 5/04
JP 2002-021554 A 1/2002
(Continued)

*Primary Examiner* — Jeremy A Luks
(74) *Attorney, Agent, or Firm* — Carrier Blackman & Associates, P.C.; William D. Blackman; Joseph P. Carrier

(57) ABSTRACT

An exhaust muffler includes first and second pipes which extend through a casing, and which are disposed so that a downstream end of the first pipe faces an upstream end of the second pipe, wherein the downstream end of the first pipe and the upstream end of the second pipe are disposed so as to be spaced from each other in an axial direction, one end part of a support member having a circular cross section that has a smaller diameter than those of the first and the second pipes is fixed to one of a first lid member covering an opening at the downstream end of the first pipe and a second lid member covering an opening at the upstream end of the second pipe, and the other end part of the support member is slidably fitted to the other of the first and the second lid members.

8 Claims, 14 Drawing Sheets

(52) U.S. Cl.
CPC ..... *F01N 2470/12* (2013.01); *F01N 2470/14* (2013.01); *F01N 2490/02* (2013.01); *F01N 2590/04* (2013.01)

(58) Field of Classification Search
CPC ..... F01N 2490/04; F01N 2450/22; F01N 2590/04; F01N 2450/24; F01N 2470/12
See application file for complete search history.

(56) References Cited

U.S. PATENT DOCUMENTS

| | | | | |
|---|---|---|---|---|
| 8,028,798 | B2 * | 10/2011 | Koyanagi | F01N 1/003 181/251 |
| 8,220,587 | B2 | 7/2012 | Mori et al. | |
| 2004/0262077 | A1 * | 12/2004 | Huff | F01N 1/023 181/250 |
| 2014/0060963 | A1 * | 3/2014 | Ono | F01N 1/089 181/228 |
| 2015/0354421 | A1 * | 12/2015 | Horr | F01N 1/166 181/241 |
| 2016/0281557 | A1 * | 9/2016 | Nakano | F01N 1/003 |
| 2019/0323396 | A1 * | 10/2019 | Ronnmark | F01N 1/003 |

FOREIGN PATENT DOCUMENTS

| | | | | |
|---|---|---|---|---|
| JP | 5315072 | B2 | 10/2013 | |
| JP | 2014-105617 | A | 6/2014 | |
| JP | 2014105617 | A * | 6/2014 | F01N 1/089 |
| JP | 2016-169610 | A | 9/2016 | |

* cited by examiner

EXHAUST MUFFLER

TECHNICAL FIELD

The present invention relates to an exhaust muffler that includes a casing, a partition wall that partitions an interior of the casing into a plurality of expansion chambers and is fixed to the casing, and a plurality of pipes that extend through either the casing or the partition wall so as to make exhaust gas flow therethrough, among the pipes first and second pipes being disposed so that a downstream end along a flow direction of exhaust gas of the first pipe coaxially faces an upstream end along a flow direction of exhaust gas of the second pipe.

BACKGROUND ART

Such an exhaust muffler is already known from Patent Document 1, and in this arrangement, a lid member closing an opening at the upstream end of a tailpipe slidably extending through a casing has its tubular portion coaxially fitted to the downstream end of a pipe extending through a partition wall, and the pipe and the tailpipe, which are disposed coaxially with each other, are supported by the partition wall and the casing.

RELATED ART DOCUMENTS

Patent Documents

Patent Document 1: Japanese Patent No. 53125072

SUMMARY OF THE INVENTION

Problems to be Solved by the Invention

The pipe within the exhaust muffler is a member exposed to high temperature and is a component that repeatedly extends and shrinks due to thermal expansion in particular, and the pipe within the exhaust muffler and the tailpipe, part of which is present outside the casing, have different amounts of sliding accompanying extension and shrinkage due to thermal expansion. Because of this, while taking into consideration a load acting on a part via which the pipe and the tailpipe are connected, it is difficult to configure the pipe within the exhaust muffler so that it is long; this is the same for a structure in which pipes are connected to each other within an exhaust muffler, and the length of the pipe is restricted, thus affecting the degree of freedom in design of the exhaust muffler.

The present invention has been accomplished in light of such circumstances, and it is an object thereof to provide an exhaust muffler for which, when carrying out connecting and supporting a pair of pipes disposed coaxially with each other, there are hardly any restrictions on the length of the pipe, and the degree of freedom in design can be enhanced.

Means for Solving the Problems

In order to attain the above object, according to a first aspect of the present invention, there is provided an exhaust muffler comprising a casing, a partition wall that partitions an interior of the casing into a plurality of expansion chambers and is fixed to the casing, and a plurality of pipes that extend through either the casing or the partition wall so as to make exhaust gas flow therethrough, among the pipes first and second pipes being disposed so that a downstream end along a flow direction of exhaust gas of the first pipe coaxially faces an upstream end of a flow direction of exhaust gas of the second pipe, characterized in that the downstream end of the first pipe and the upstream end of the second pipe are disposed so as to be spaced from each other in an axial direction, one end part of a support member having a circular cross section that has a smaller diameter than diameters of the first and the second pipes is fixed to one of a first lid member covering an opening at the downstream end of the first pipe and a second lid member covering an opening at the upstream end of the second pipe, and the other end part of the support member is slidably fitted to the other of the first and the second lid members.

Further, according to a second aspect of the present invention, in addition to the first aspect, opposite end parts of the support member, which is formed from a cylindrical pipe material, are disposed so as to extend through the first lid member and the second lid member.

According to a third aspect of the present invention, in addition to the second aspect, the support member is disposed coaxially with the first pipe and the second pipe.

According to a fourth aspect of the present invention, in addition to the second or third aspect, a support tube portion is projectingly provided integrally with one of the first lid member and the second lid member so as to project toward a side opposite to the other of the first lid member and the second lid member, the one end part of the support member extending through the support tube portion, and an outer peripheral face of the one end part of the support member is welded to a projecting edge of the support tube portion.

According to a fifth aspect of the present invention, in addition to any one of the first to fourth aspects, an external diameter of the second pipe is set to be smaller than an external diameter of the first pipe.

According to a sixth aspect of the present invention, in addition to any one of the first to fifth aspects, the second pipe is a tailpipe that extends through the casing and is fixed to the casing, and one end part of the support member is fixed to the first lid member.

According to a seventh aspect of the present invention, in addition to any one of the first to sixth aspects, a plurality of punched holes are formed in a side wall, at least on the downstream side, of the first pipe.

Moreover, according to an eighth aspect of the present invention, in addition to any one of the first to seventh aspects, a recess part recessed toward a side away from a rear wheel is formed in a side wall facing the rear wheel side of a front part of the casing in a vehicle fore-and-aft direction, and an upstream end of the first pipe extending through a plurality of the partition walls, which are disposed so as to be spaced in the vehicle fore-and-aft direction, is disposed within the casing in a portion corresponding to the recess part.

It should be noted here that an inlet pipe 54, a first communication pipe 55, a second communication pipe 56, a first tailpipe 57 and a second tailpipe 58 of an embodiment correspond to the pipe of the present invention; in particular the first communication pipe 55 corresponds to the first pipe of the present invention, and the first tailpipe 57 corresponds to the second pipe of the present invention.

Effects of the Invention

In accordance with the first aspect of the present invention, coaxially opposing end parts of the pair of pipes disposed coaxially with each other are spaced from each other, the support member fixed to one of the lid members individually closing the mutually opposing open end parts of the pipes is slidably fitted to the other lid member, and it is thereby possible to mutually support the pair of pipes while allowing extension and shrinkage due to thermal expansion of the two pipes by means of the gap between the two pipes, thus making the length of the pipe be unaffected by restrictions and enhancing the degree of freedom in design of the exhaust muffler.

Furthermore, in accordance with the second aspect of the present invention, since the support member is formed from a cylindrical pipe material and the support member extends through the first lid member and the second lid member, it is possible, by making exhaust gas flow that has been blocked by the lid member flow via the support member, to obtain an effect in preventing the pressure at the downstream end of the first pipe on the upstream side from increasing excessively.

In accordance with the third aspect of the present invention, since the support member is coaxial with the first and second pipes, it is possible to equalize the flow of exhaust gas between end parts of the first and second pipes, thus making it difficult for local build-up to occur.

In accordance with the fourth aspect of the present invention, since the outer peripheral face of one end part of the support member is welded to the projecting edge of the support tube portion projectingly provided on the lid member on the side where the support member is fixed, it is possible, by preventing the weld bead of the weld part from decreasing the flow area in the interior of the support member, to ensure the flow performance.

In accordance with the fifth aspect of the present invention, since the external diameter of the second pipe is smaller than the external diameter of the first pipe, it is possible, by making the thermal expansion characteristics of the first and second pipes be different from each other, to prevent interference from occurring therebetween due to the thermal expansions amplifying each other under the same conditions.

In accordance with the sixth aspect of the present invention, since the tailpipe is strongly fixed to the casing, even if a force due to frictional resistance between the second lid member and the support member slidably supported on the second lid member is applied to the tailpipe, it is possible to prevent there being a large influence on the part via which the tailpipe and the casing are joined.

In accordance with the seventh aspect of the present invention, since the plurality of punched holes are formed in the side wall at least on the downstream side of the first pipe extending through the partition wall, it is possible to diffuse exhaust gas that has been blocked by the first lid member into the expansion chamber via the punched holes, thus reducing the exhaust gas pressure, decreasing the exhaust energy, and enhancing the muffling effect.

Furthermore, in accordance with the eighth aspect of the present invention, since the upstream end of the first pipe is disposed within the casing in a portion corresponding to the recess part formed in the side wall portion of the front part of the casing, although placement of the pipe is restricted due to formation of the recess part for avoiding interference with peripheral equipment of the rear wheel, it is possible, by using effectively the first pipe, which has a long pipe length due to it extending through the plurality of partition walls, to ensure the function of the exhaust muffler.

EXPLANATION OF REFERENCE NUMERALS AND SYMBOLS

Figure 1:
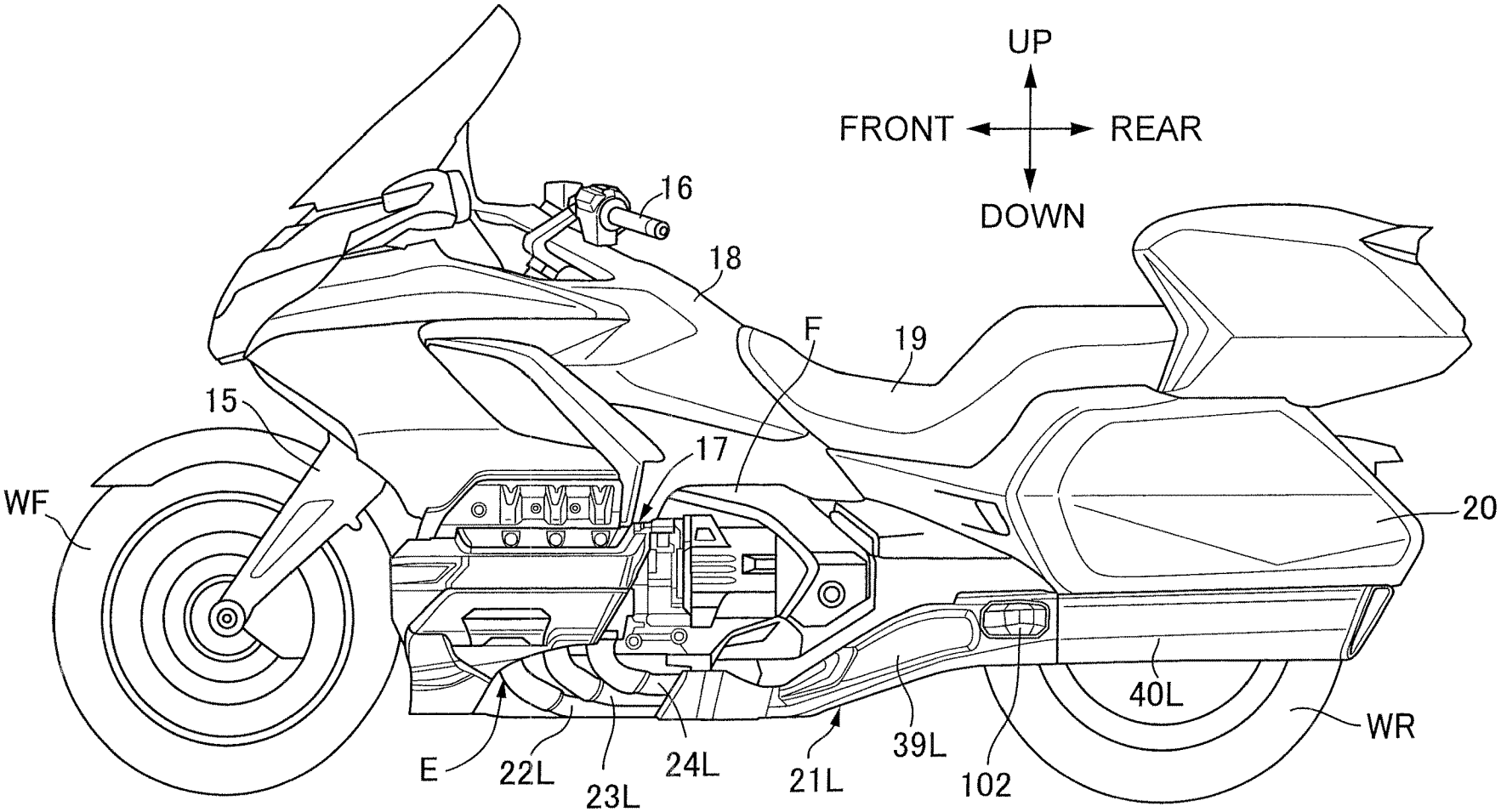
FIG. 1 is a left side view of a two-wheeled motor vehicle. (first embodiment)

30L, 30R Exhaust muffler
43L, 43R Casing
51, 52, 53 Expansion chamber
49L, 49R, 50 Partition wall
54 Inlet pipe
55 First communication pipe, which is a first pipe
55*a* Downstream end of first communication pipe
56 Second communication pipe
57 First tailpipe, which is a second pipe
57*a* Upstream end of first tailpipe
58 Second tailpipe
63 First lid member
65 Punched hole
63*a* Support tube portion
69, 70 Flow direction
72 Second lid member
75 Support member
78 Recess part

MODES FOR CARRYING OUT THE INVENTION

An embodiment of the present invention is explained by reference to FIG. 1 to FIG. 13. In the explanation below, front and rear, up and down, and left and right mean directions as viewed by a person riding a two-wheeled motor vehicle.

First Embodiment

First, in FIG. 1, a front fork 15 and bar-shaped handlebars 16 are steerably supported on a front end part of a vehicle body frame F of a two-wheeled motor vehicle, which is a saddled vehicle, a front wheel WF being axially supported on a lower end part of the front fork 15, and an engine main body 17 of an internal combustion engine E, which is a horizontally-opposed six cylinder engine exerting power for driving a rear wheel WR, is mounted on the vehicle body frame F so that three cylinders are disposed on each of left and right sides. A fuel tank 18 disposed above the engine main body 17 is supported on the vehicle body frame F, a riding seat 19 is disposed to the rear of the fuel tank 18, and a saddle bag 20 is disposed beneath the left and the right sides of a rear part of the riding seat 19.

Figure 2:
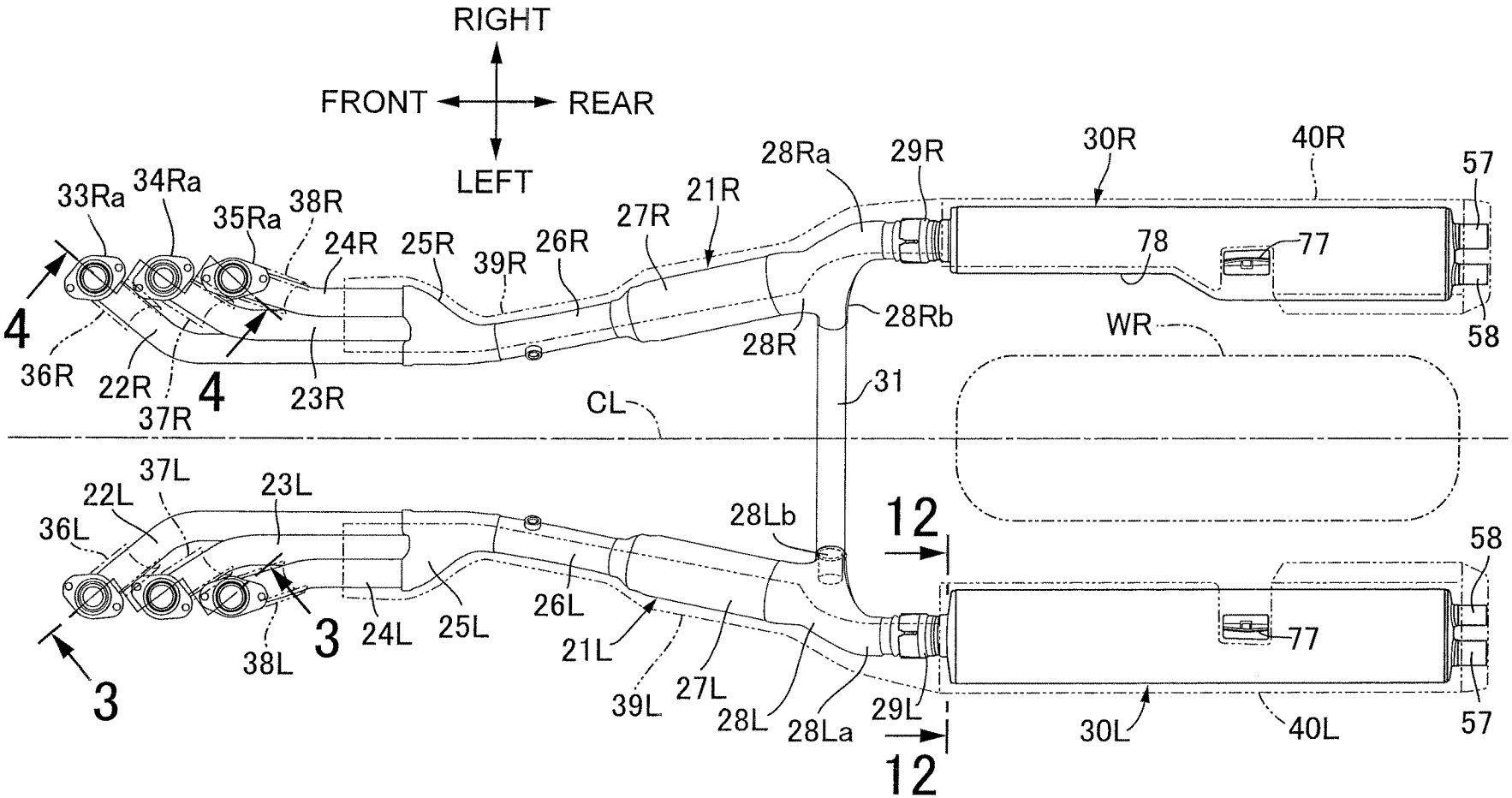
FIG. 2 is a plan view of an exhaust device of an internal combustion engine. (first embodiment)

Referring in addition to FIG. 2, connected to the engine main body 17 are left and right exhaust devices 21L and 21R, which are separately positioned on the left and right of a vehicle body center line CL passing through the center in the width direction of the vehicle body. The left exhaust device 21L includes left first, second, and third individual exhaust pipes 22L, 23L, and 24L individually corresponding to each cylinder of a left cylinder head (not illustrated) of the engine main body 17, a left confluence pipe 25L to which downstream ends of the left first to third individual exhaust pipes 22L to 24L are connected in common so that exhaust gas flowing through the individual exhaust pipes 22L to 24L is combined, a left collecting exhaust pipe 26L connected to the downstream end of the left confluence pipe 25L and extending rearward, a left catalytic converter 27L having an upstream end connected to the downstream end of the left collecting exhaust pipe 26L, a left branched pipe 28L having an upstream end connected to the downstream end of the left catalytic converter 27L, and a left exhaust muffler 30L connected to the left branched pipe 28L and disposed on the left outer side, in the vehicle width direction, of the rear wheel WR while overlapping the rear wheel WR when viewed from the side.

The right exhaust device 21R includes right first, second, and third individual exhaust pipes 22R, 23R, and 24R individually corresponding to each cylinder of a right cylinder head (not illustrated) of the engine main body 17, a right confluence pipe 25R to which downstream ends of the right first to third individual exhaust pipes 22R to 24R are connected in common so that exhaust gas flowing through the individual exhaust pipes 22R to 24R is combined, a right collecting exhaust pipe 26R connected to the downstream end of the right confluence pipe 25R and extending rearward, a right catalytic converter 27R having an upstream end connected to the downstream end of the right collecting exhaust pipe 26R, a right branched pipe 28R having an upstream end connected to the downstream end of the right catalytic converter, and a right exhaust muffler 30R connected to the right branched pipe 28R and disposed on the right outer side in the vehicle width direction of the rear wheel WR while overlapping the rear wheel WR when viewed from the side.

The left branched pipe 28L has a main branched pipe portion 28La connected to the left exhaust muffler 30L and an auxiliary branched pipe portion 28Lb and is formed into a bifurcated shape, and the right branched pipe 28R has a main branched pipe portion 28Ra connected to the right exhaust muffler 30R and an auxiliary branched pipe portion 28Rb and is formed into a bifurcated shape. Moreover, the auxiliary branched pipe portion 28Lb of the left branched pipe 28L and the auxiliary branched pipe portion 28Rb of the right branched pipe 28R are connected to opposite end parts of a communication pipe 31 extending in the vehicle width direction in front of the rear wheel WR.

Figure 3:
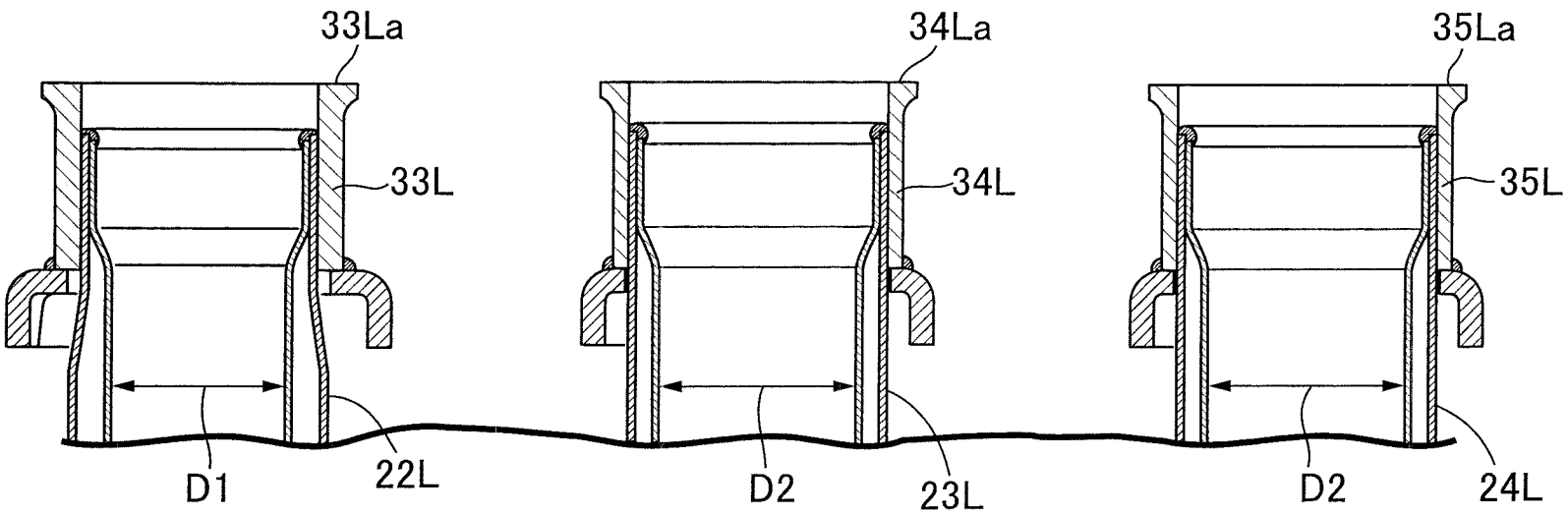
FIG. 3 is a sectional view along line 3-3 in FIG. 2. (first embodiment)

In FIG. 3, the left first to third individual exhaust pipes 22L to 24L are each formed into a double pipe shape, left first, second, and third connecting pipes 33L, 34L, and 35L having flange portions 33La, 34La, and 35La are individually fitted and fixed to upstream ends of the left first to third individual exhaust pipes 22L to 24L, and the flange portions 33La to 35La are joined to the left cylinder head. The left first, second and third individual exhaust pipes 22L to 24L are arranged side by side in the vehicle width direction so that the left first individual exhaust pipe 22L in front in the vehicle fore-and-aft direction is disposed on the innermost side in the vehicle width direction, and extend rearward in the vehicle fore-and-aft direction.

Figure 4:
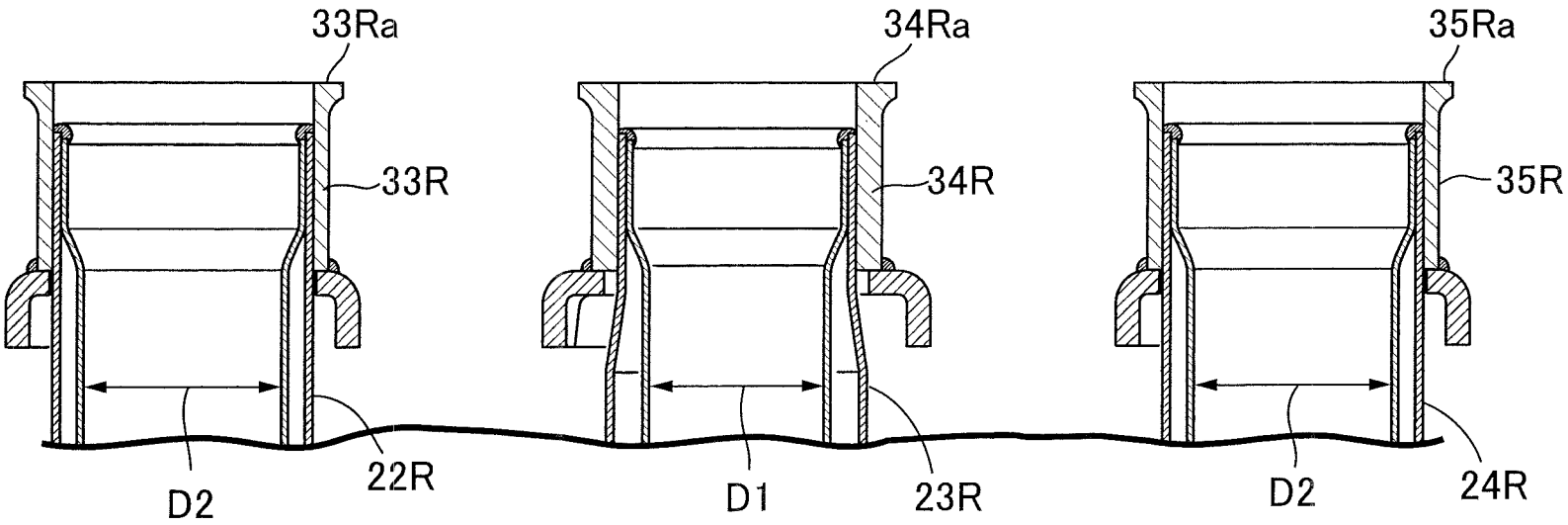
FIG. 4 is a sectional view along line 4-4 in FIG. 2. (first embodiment)

In FIG. 4, the right first to third individual exhaust pipes 22R to 24R are each formed into a double pipe shape, right first, second, and third connecting pipes 33R, 34R, and 35R having flange portions 33Ra, 34Ra, and 35Ra are individually fitted and fixed to upstream ends of the right first to third individual exhaust exhaust pipes 22R to 24R, and the flange portions 33Ra to 35Ra are joined to the right cylinder head. The right first, second, and third individual exhaust pipes 22R to 24R are arranged side by side in the vehicle width direction so that the right first individual exhaust pipe 22R in front in the vehicle fore-and-aft direction is disposed on the innermost side in the vehicle width direction, and extend rearward in the vehicle fore-and-aft direction.

Some of the left first to third individual exhaust pipes 22L to 24L and some of the right first to third individual exhaust pipes 22R to 24R are formed so as to have different internal diameters from those of the other exhaust pipes in order to obtain a characteristic exhaust noise, and in this embodiment, as shown in FIG. 3, an internal diameter D1 of the left first individual exhaust pipe 22L is set to be smaller than an internal diameter D2 of the left second and third individual exhaust pipes 23L and 24L (D1<D2) and, as shown in FIG. 4, the internal diameter D1 of the right second individual exhaust pipe 23R is set to be smaller than the internal diameter D2 of the right first and third individual exhaust pipes 22R and 24R (D1<D2).

As shown by a chain line in FIG. 2, the left first to third individual exhaust pipes 22L to 24L are covered from above by left first, second, and third individual exhaust pipe covers 36L, 37L, and 38L individually mounted on the individual exhaust pipes 22L to 24L, and the right first to third individual exhaust pipes 22R to 24R are covered from above by right first, second, and third individual exhaust pipe covers 36R, 37R, and 38R individually mounted on the individual exhaust pipes 22R to 24R. A section from the left confluence pipe 25L, via the left collecting exhaust pipe 26L, the left catalytic converter 27L, and the left branched pipe 28L, to a front end part of the left exhaust muffler 30L is covered by a left collecting exhaust pipe cover 39L from above and the left, and a section from the right confluence pipe 25R, via the right collecting exhaust pipe 26R, the right catalytic converter 27R, and the right branched pipe 28R, to a front end part of the right exhaust muffler 30R is covered by a right collecting exhaust pipe cover 39R from above and the right. The left exhaust muffler 30L is covered by a left muffler protector 40L, and the right exhaust muffler 30R is covered by a right muffler protector 40R.

Figure 5:
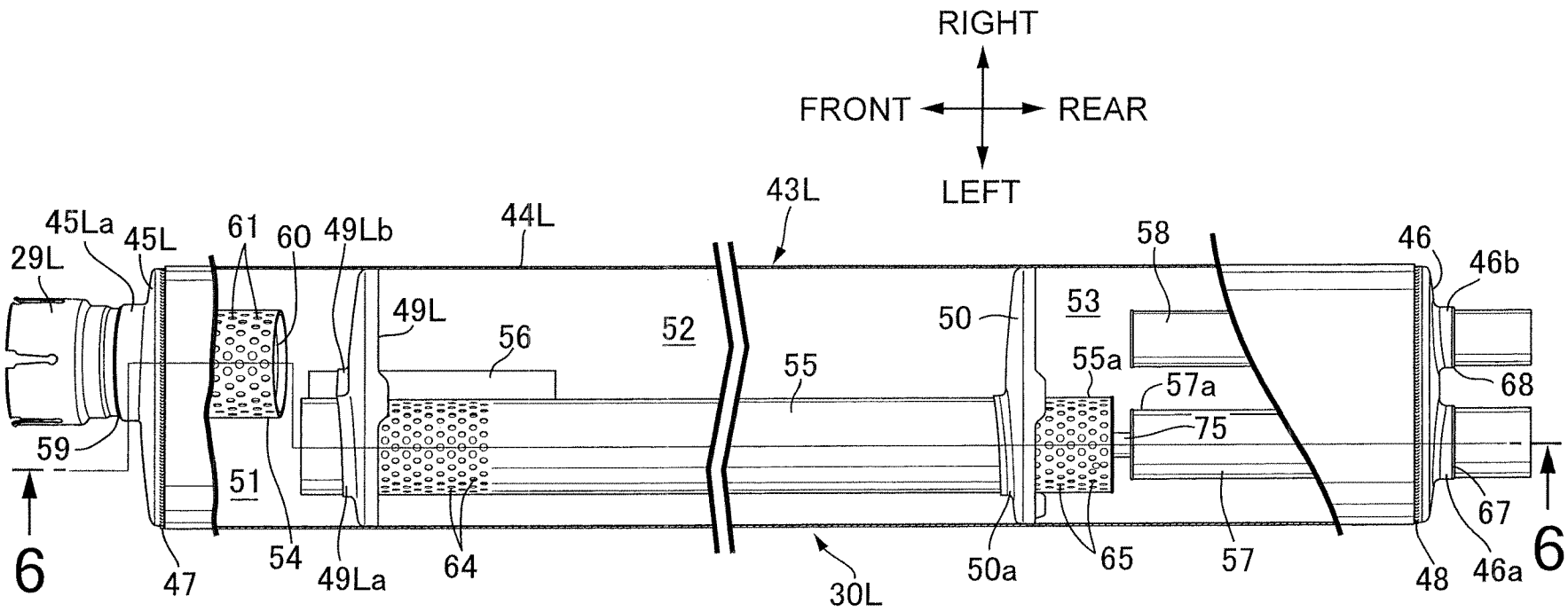
FIG. 5 is a sectional plan view of a left exhaust muffler. (first embodiment)
Figure 6:
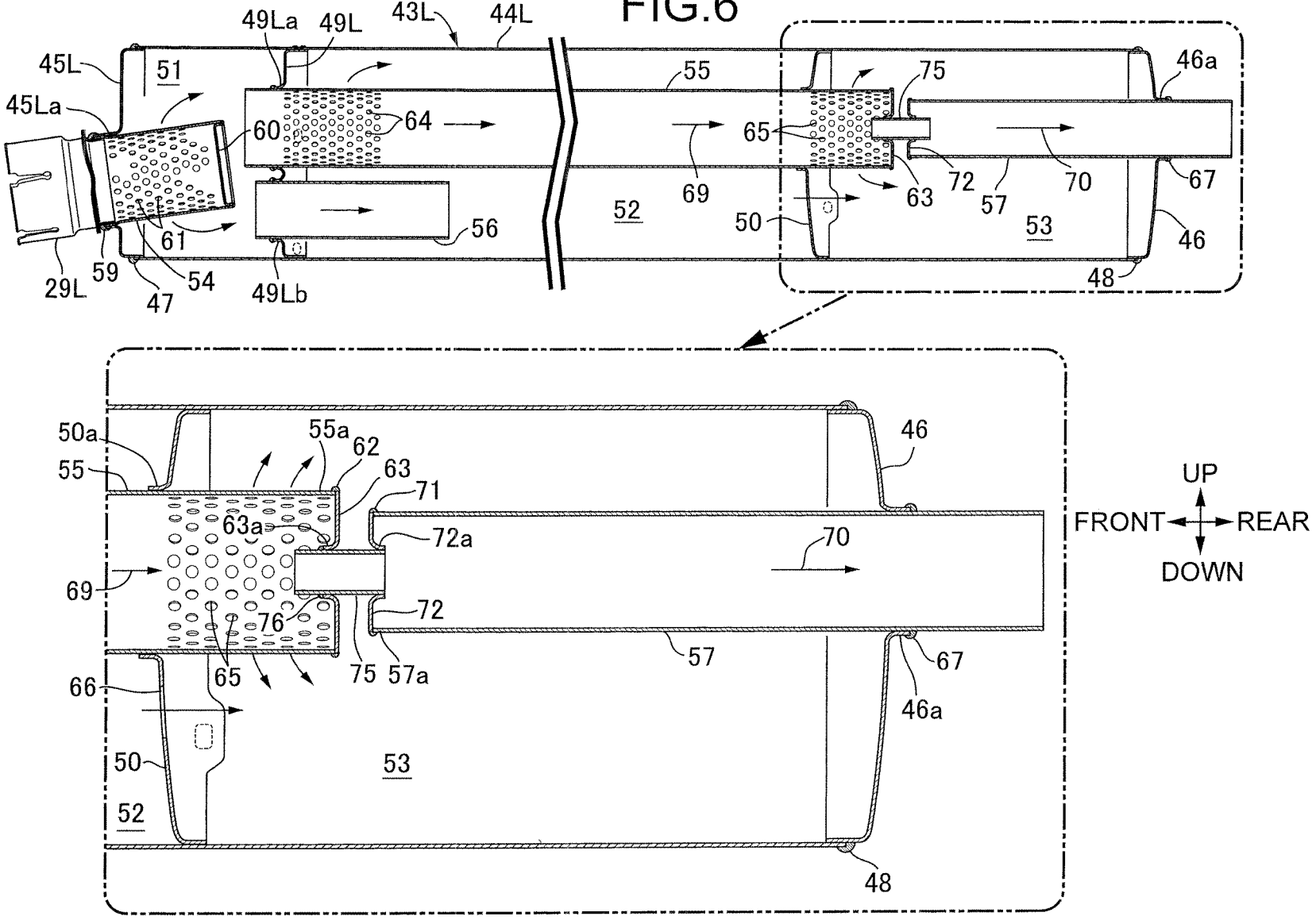
FIG. 6 is a sectional view along line 6-6 in FIG. 5. (first embodiment)

In FIG. 5 and FIG. 6, a casing 43L of the left exhaust muffler 30L is formed from a cylindrical casing main body 44L, a front end wall 45L joined to a front end part of the casing main body 44L along the vehicle fore-and-aft direction by means of welding of a first weld part 47, and a rear end wall 46 joined to a rear end part of the casing main body 44L along the vehicle fore-and-aft direction by means of welding of a second weld part 48.

The interior of the casing 43L is divided into a plurality of expansion chambers 51, 52, and 53 by means of a plurality of partition walls 49L and 50 which are spaced apart from one another and disposed with a gap therebetween in the vehicle fore-and-aft direction. In this embodiment, the outer periphery of each of the first and second partition walls 49L and 50, respectively, is fixed to an inner face of the casing main body 44L by welding, at positions spaced apart in the vehicle fore-and-aft direction. Formed within the casing 43L are the first expansion chamber 51 between the front end wall 45L and the first partition wall 49L, the second expansion chamber 52 between the first and second partition walls 49L and 50, and the third expansion chamber 53 between the second partition wall 50 and the rear end wall 46.

The left exhaust muffler 30L includes a plurality of pipes extending through any of the casing 43L and the first and second partition walls 49L and 50 so that exhaust gas flows, and in this embodiment the left exhaust muffler 30L includes an inlet pipe 54 extending through the front end wall 45L of the casing 43L, a first communication pipe 55 extending through the first and second partition walls 49L and 50, a second communication pipe 56 extending through the first partition wall 49L, a first tailpipe 57 disposed coaxially with the first communication pipe 55 and extending through the rear end wall 46 of the casing 43L, and a second tailpipe 58 arranged on the inner side in the vehicle width direction of the first tailpipe 57 and extending through the rear end wall 46.

A cylindrical first support tube portion 45La projecting forward with an axis inclined downward to the front is projectingly provided integrally with the front end wall 45L of the casing 43L, and a front end part, in the vehicle fore-and-aft direction, of the inlet pipe 54 inclined downward to the front is inserted into the first support tube 45La. On the other hand, the downstream end of a left connecting pipe 29L is fitted onto a front end part of the inlet pipe 54, the main branched pipe portion 28La of the left branched pipe 28L being fitted into and connected to the left connecting pipe 29L, and the front edge of the first support tube portion 45La is welded to the front edge of the inlet pipe 54 and the outer periphery of the left connecting pipe 29L via a third weld part 59.

The downstream end of the inlet pipe 54 is closed by a plate-shaped plug member 60 press fitted into the inlet pipe 54, and a plurality of first punched holes 61 are formed in the side wall of the inlet pipe 54 within the first expansion chamber 51. Exhaust gas introduced into the left exhaust muffler 30L via the inlet pipe 54 is therefore dispersed within the first expansion chamber 51 via the plurality of first punched holes 61.

Second and third support tube portions 49La and 49Lb projecting toward the first expansion chamber 51 side are projectingly provided integrally with the first partition wall 49L, and the second communication pipe 56 is fitted into and supported on the third support tube portion 49Lb, which is disposed further downward than the second support tube portion 49La, opposite ends of the second communication pipe 56 opening in the first and second expansion chambers 51 and 52. That is, the first and second expansion chambers 51 and 52 communicate with each other via the second communication pipe 56.

A fourth support tube portion 50*a* that is coaxial with and has the same diameter as that of the second support tube portion 49La is projectingly provided integrally with the second partition wall 50 so as to project toward the second expansion chamber 52 side, and the first communication pipe 55 is fitted into and supported on the third and the fourth support tube portions 49La and 50*a* so that its upstream end opens in the first expansion chamber 51. That is, the first communication pipe 55 extends through the first and second partition walls 49L and 50.

A downstream end 55*a* of the first communication pipe 55 along a flow direction 69 of exhaust gas within the first communication pipe 55 projects into the third expansion chamber 53, and an opening at the downstream end 55*a* of the first communication pipe 55 is covered by a first lid member 63 welded to the first communication pipe 55 via a fourth weld part 62. Of the side wall of the first communication pipe 55, a plurality of punched holes are formed in at least the side wall on the downstream side; in this embodiment, a plurality of second punched holes 64 are formed in the side wall of a portion, close to the first partition wall 49L within the second expansion chamber 52, of the first communication pipe 55, and a plurality of third punched holes 65 are formed in the side wall of a portion, facing the third expansion chamber 53 on the downstream side, of the first communication pipe 55. Exhaust gas introduced into the first expansion chamber 51 is therefore guided to the second expansion chamber 52 via the second communication pipe 56, is dispersed from the interior of the first communication pipe 55 into the second expansion chamber 52 via the second punched holes 64, and is further dispersed from the first communication pipe 55 into the third expansion chamber 53 via the third punched holes 65. A communication hole 66 is bored in the second partition wall 50, and exhaust gas flows from the second expansion chamber 52 to the third expansion chamber 53 via the communication hole 66.

Fifth and sixth support tube portions 46*a* and 46*b* extending in the vehicle fore-and-aft direction are projectingly provided integrally with the rear end wall 46 of the casing 43L so as to project rearward in the vehicle fore-and-aft direction, the fifth support tube portion 46*a* being disposed coaxially with the first communication pipe 55, and the sixth support tube portion 46*b* being disposed further on the inner side than the fifth support tube portion 46*a* in the vehicle width direction, that is, on the rear wheel WR side.

The first tailpipe 57 extends through the fifth support tube portion 46*a* and is disposed coaxially with the first communication pipe 55, and the outer periphery of the first tailpipe 57 is welded to the rear edge of the fifth support tube portion 46*a* via a fifth weld part 67. The second tailpipe 58 extends through the sixth support tube portion 46*b*, the outer periphery of the second tailpipe 58 is welded to the rear edge of the sixth support tube portion 46*b* via a sixth weld part 68, and exhaust gas within the third expansion chamber 53 is discharged outside via the second tailpipe 58.

The downstream end 55*a* of the first communication pipe 55, which is a first pipe among the plurality of pipes of the left exhaust muffler 30L, and an upstream end 57*a* of the first tailpipe 57 along a flow direction 70 of exhaust gas flowing in the interior of the first tailpipe 57, which is a second pipe among the plurality of pipes, are disposed so as to be spaced from each other in the axial direction. An opening at the upstream end 57*a* of the first tailpipe 57 having an external diameter that is smaller than that of the first communication pipe 55 is covered by a second lid member 72 welded to the first tailpipe 57 via a seventh weld part 71.

One end part of a support member 75 having a circular cross section that has a smaller diameter than that of the first communication pipe 55 and the first tailpipe 57 is fixed to one of the first lid member 63 of the downstream end 55*a* of the first communication pipe 55 and the second lid member 72 of the upstream end 57*a* of the first tailpipe 57, in this embodiment the first lid member 63, and the other end part of the support member 75 is slidably fitted into the other of the first and the second lid members 63 and 72, in this embodiment the second lid member 72.

Opposite end parts of the support member 75, which is formed from a cylindrical pipe material and is disposed coaxially with the first communication pipe 55 and the first tailpipe 57, extend through the first lid member 63 and the second lid member 72 and are positioned, a seventh support tube portion 63*a* is projectingly provided integrally with the first lid member 63 so as to project to the side opposite to the second lid member 72, the one end part of the support member 75 extending through the seventh support tube portion 63*a*, and an outer peripheral face of the one end part of the support member 75 is welded to the projecting edge of the seventh support tube portion 63*a* via an eighth weld part 76. An eighth support tube portion 72*a* is projectingly provided integrally with the second lid member 72 so as to project to the side opposite to the first lid member 63, and the downstream end of the support member 75 is slidably fitted into the eighth support tube portion 72*a*.

The upstream end of the support member 75 opens coaxially within the downstream end 55*a* of the first communication pipe 55. The downstream end of the support member 75 opens coaxially within the first tailpipe 57, and part of the exhaust gas that has flowed through the interior of the first communication pipe 55 up to the downstream end 55*a* is guided into the first tailpipe 57 via the support member 75 and discharged to the outside via the first tailpipe 57.

A support arm 77 extending upward is fixed to an upper face of an intermediate part, in the fore-and-aft direction, of the casing 43L of the left exhaust muffler 30L, and an upper end part of the support arm 77 is supported on a rear part of the vehicle body frame F.

The right exhaust muffler 30R has the same basic internal structure as that of the left exhaust muffler 30L although part of the casing 43L has a different shape from that of the left exhaust muffler 30L; in the explanation of the right exhaust muffler 30R below parts corresponding to those of the left exhaust muffler 30L are denoted by the same reference numerals and symbols and only illustrated, and detailed explanation thereof is omitted.

Figure 7:
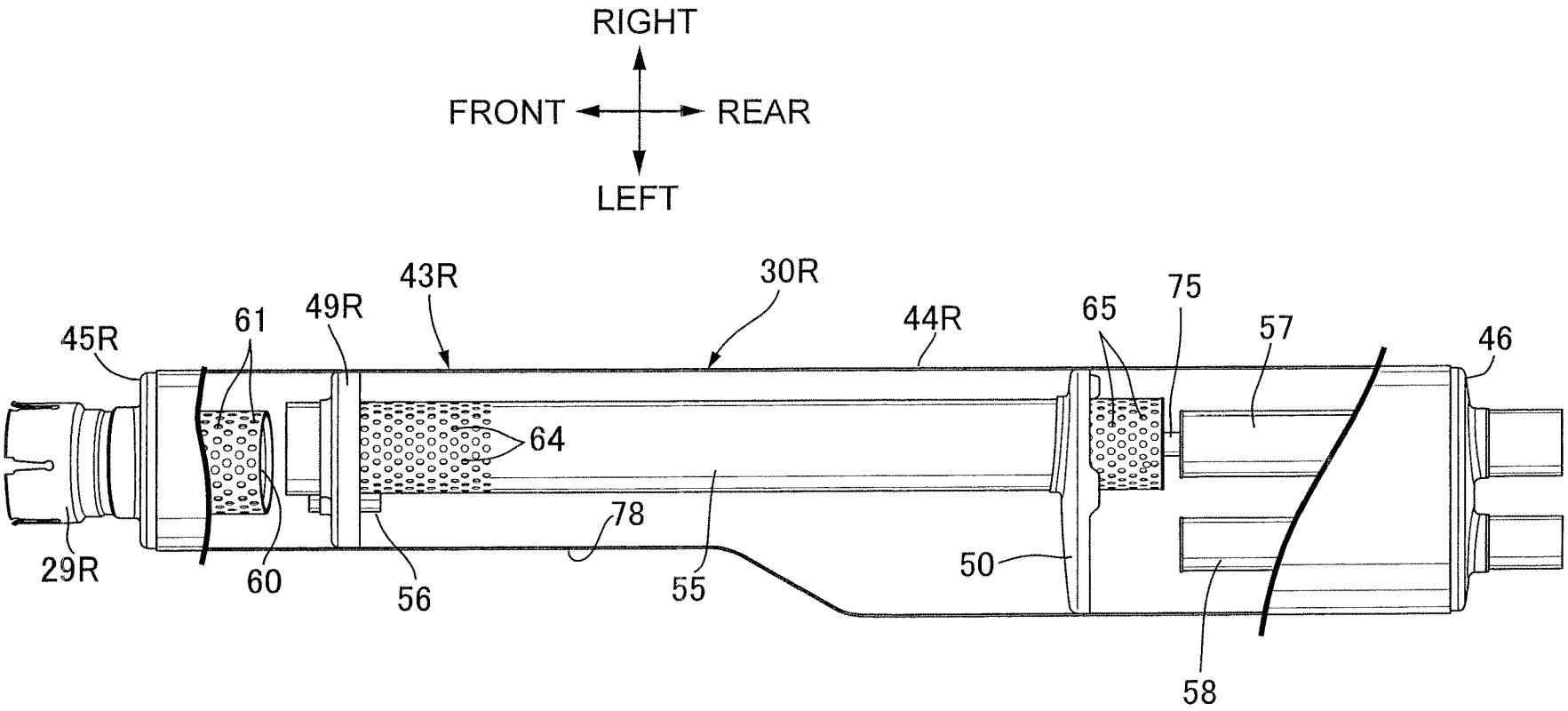
FIG. 7 is a sectional plan view of a right exhaust muffler. (first embodiment)
Figure 8:
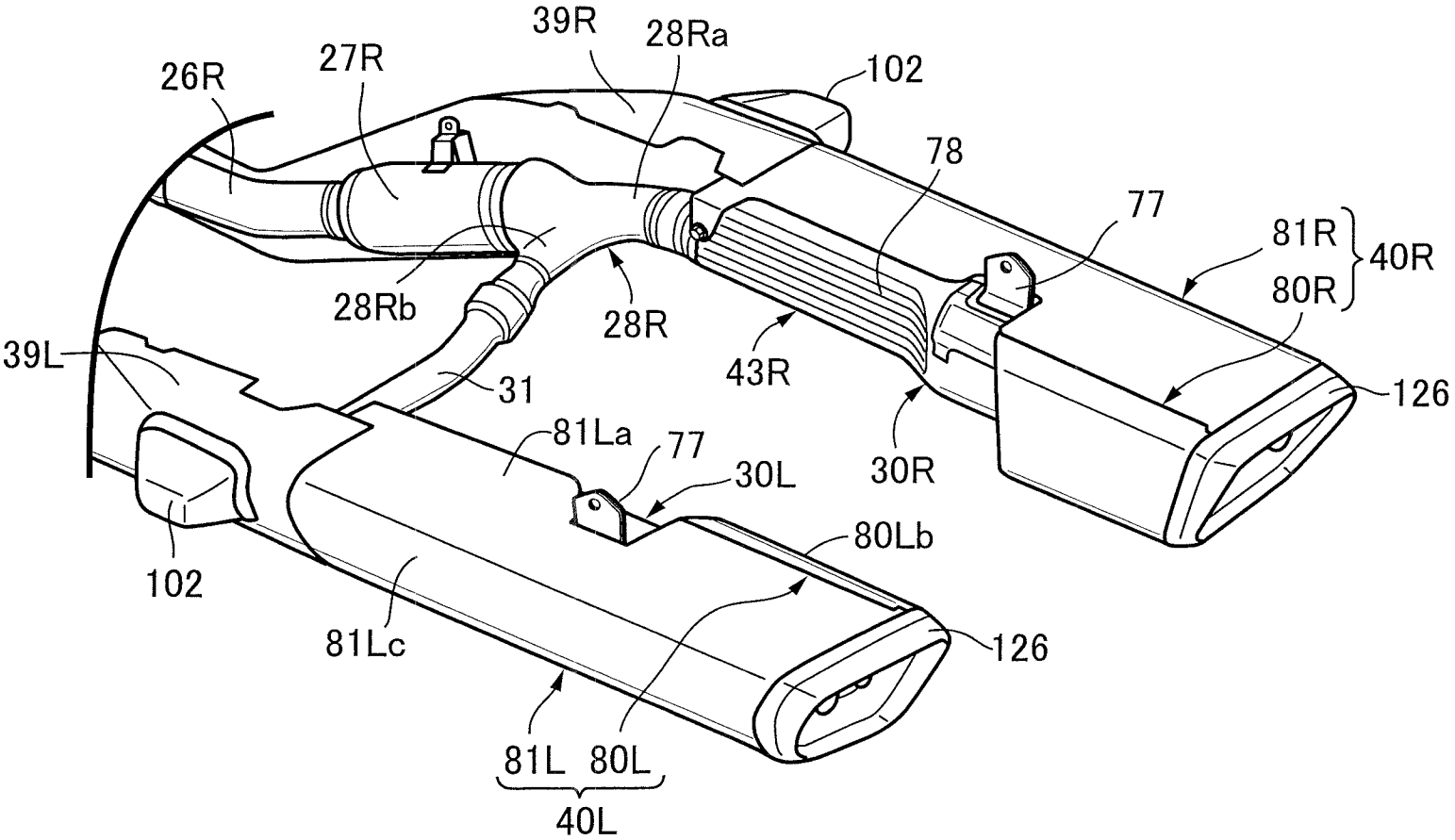
FIG. 8 is a perspective view of a rear part of the exhaust device when viewed from the rear left side and obliquely upward. (first embodiment)
Figure 9:
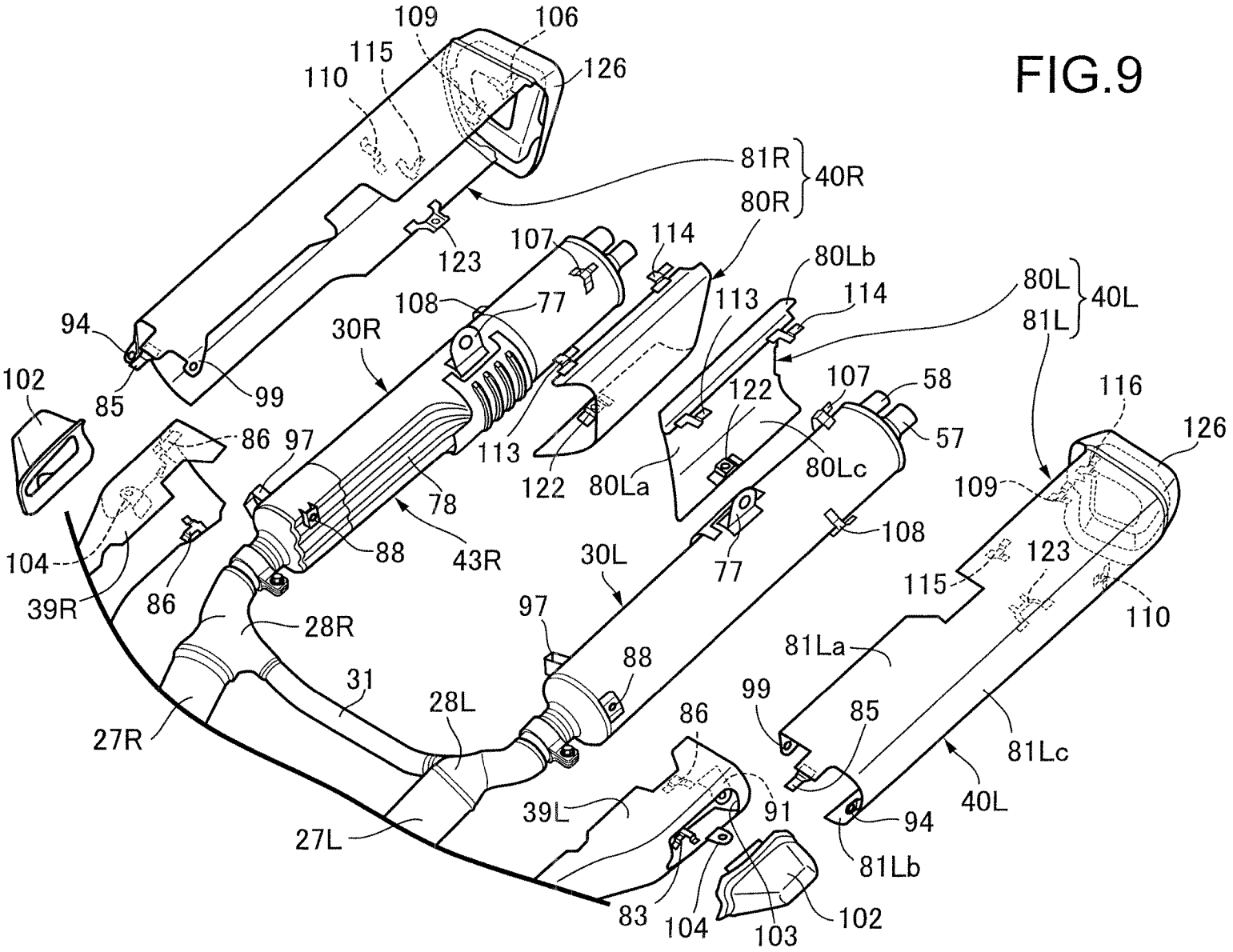
FIG. 9 is an exploded perspective view of the rear part of the exhaust device when viewed from the front left side and obliquely upward. (first embodiment)
Figure 10:
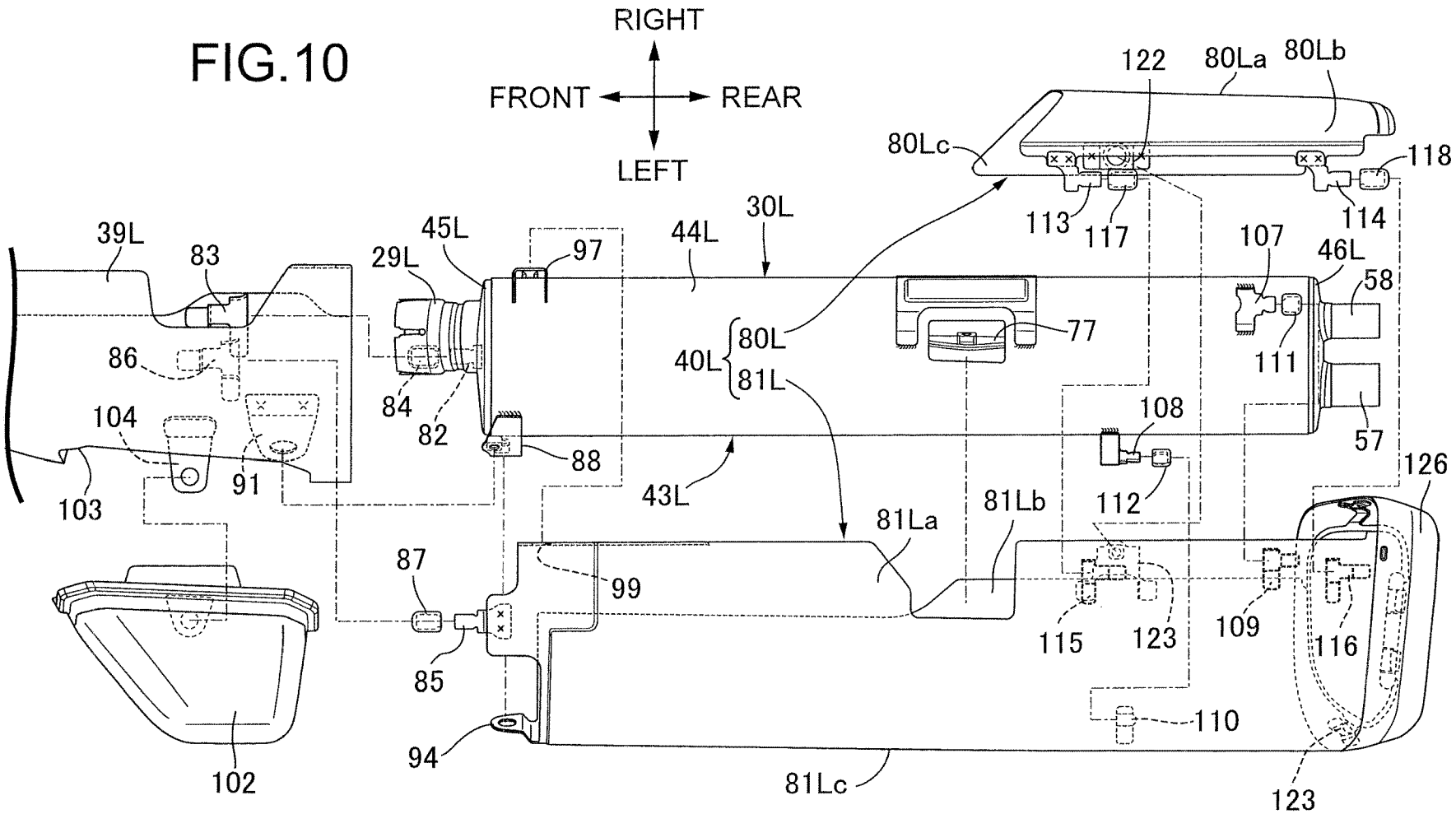
FIG. 10 is an exploded plan view of the left exhaust muffler, a rear part of a left common exhaust pipe cover, the left exhaust muffler, a left outer muffler, and a left inner muffler. (first embodiment)
Figure 11:
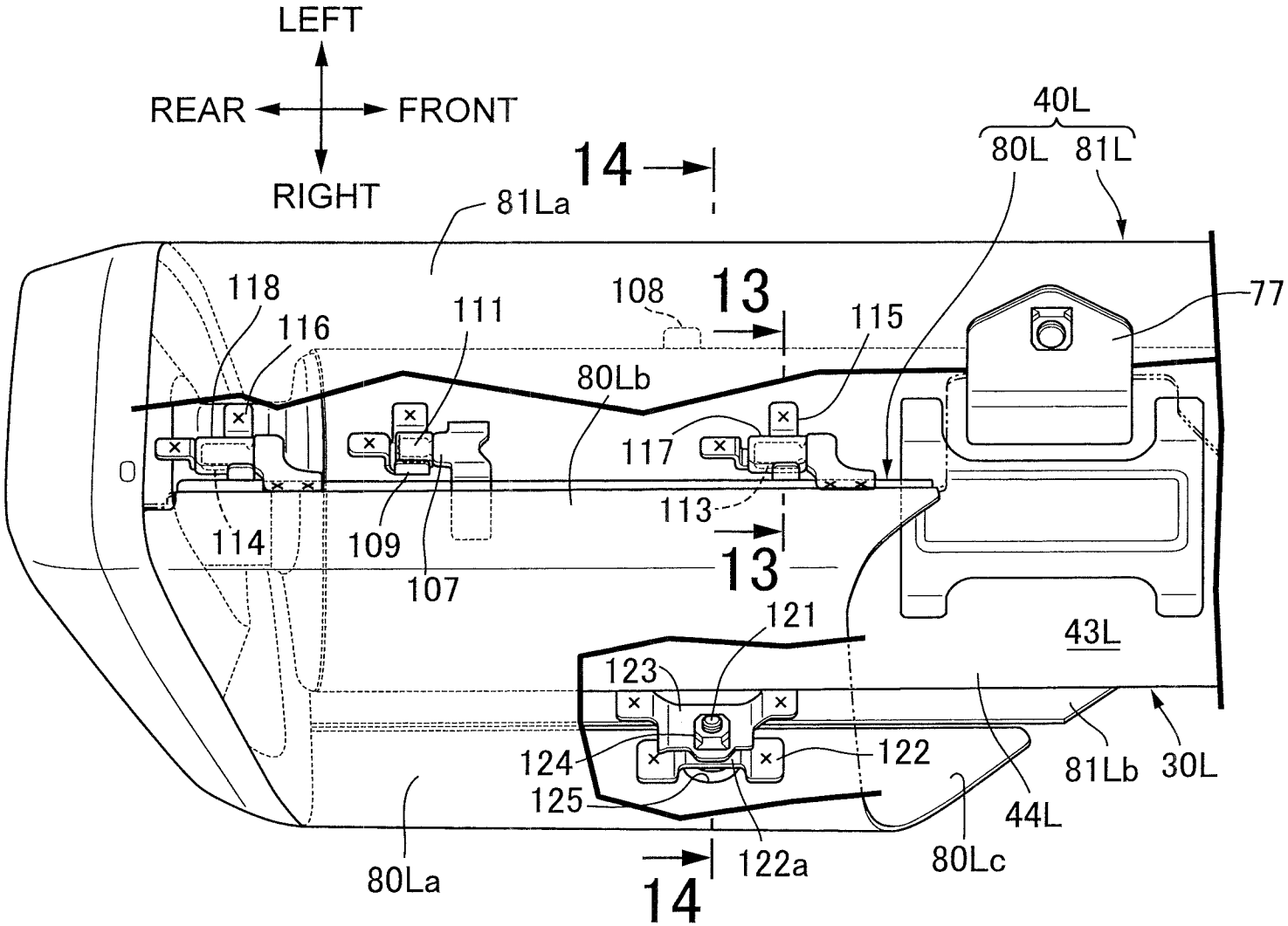
FIG. 11 is a partially cutaway perspective view of a rear part of the left exhaust muffler when viewed from the front right side and obliquely upward. (first embodiment)
Figure 12:
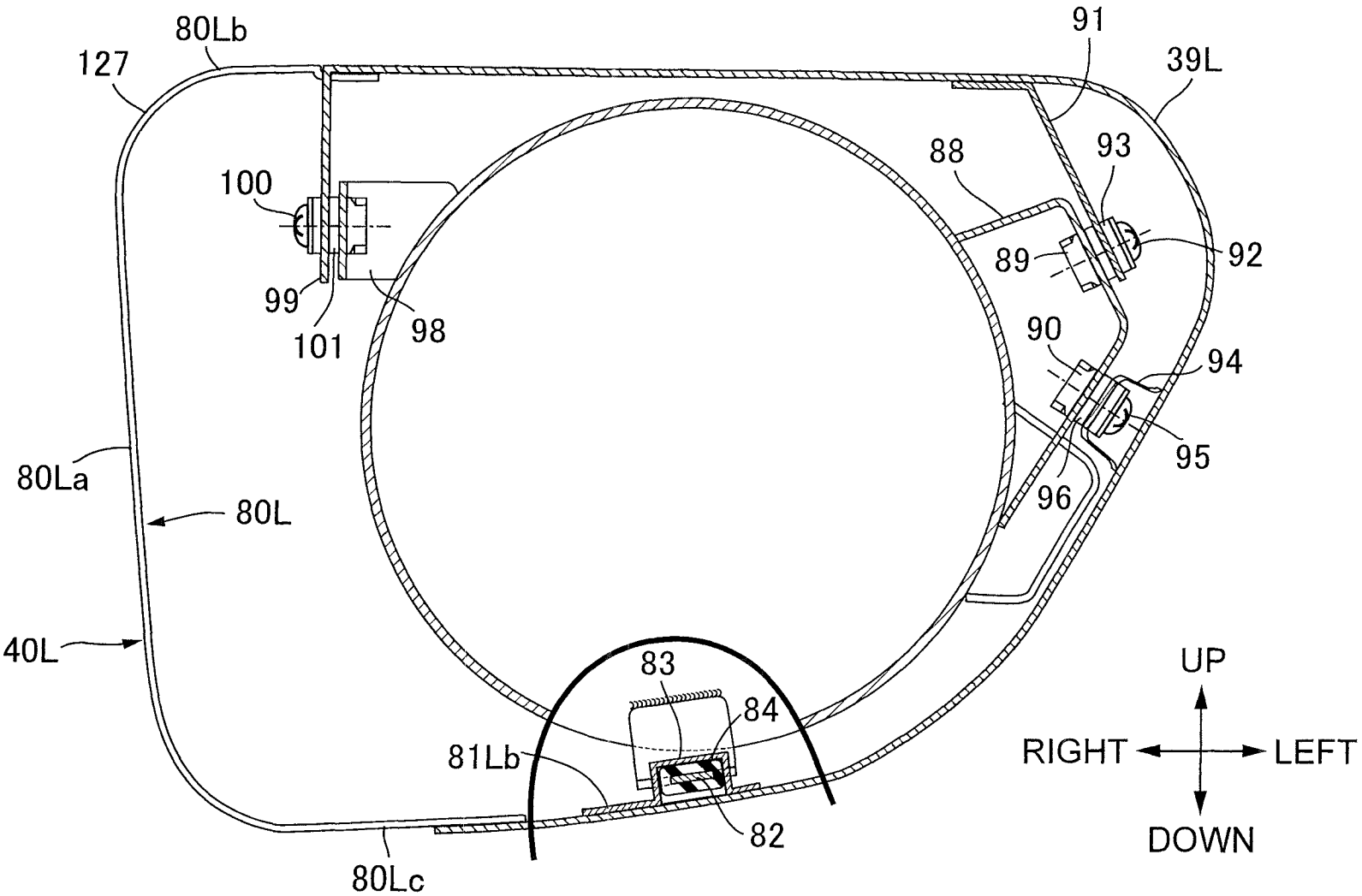
FIG. 12 is a sectional view along line 12-12 in FIG. 2. (first embodiment)

In FIG. 7, a casing 43R of the right exhaust muffler 30R is formed from a tubular casing main body 44R, a front end wall 45R joined to a front end part, in the vehicle fore-and-aft direction, of the casing main body 44R, and a rear end wall 46 joined to a rear end part of the casing main body 44R in the vehicle fore-and-aft direction.

A recess part 78 that is recessed to the side away from the rear wheel WR is formed in a side wall portion of a front part of the casing 43R in the vehicle fore-and-aft direction, that is, a side wall facing the rear wheel WR side of a front part of the casing main body 44R, in order to avoid interference with peripheral equipment of the rear wheel WR, for example, a component forming a brake mechanism fitted to the rear wheel WR. Because of this, the front part of the casing 43R of the right exhaust muffler 30R is formed with a smaller diameter than that of the rear part, a first partition wall 49R fixed to a front inner peripheral face of the casing main body 44R is formed so as to be smaller than a second partition wall 50 fixed to a rear inner peripheral face of the casing main body 44R, and the front end wall 45R is formed so as to be smaller than the rear end wall 46.

The upstream end of the first communication pipe 55, which is long due to it extending through the first and second partition walls 49R and 50, is disposed within the casing 43R in a portion corresponding to the recess part 78.

Referring in addition to FIG. 8 to FIG. 12, the left muffler protector 40L, which covers the left exhaust muffler 30L, is formed from a left inner protector half body 80L covering the left exhaust muffler 30L from the rear wheel WR side, that is, the right side in the vehicle width direction, and a left outer protector half body 81L, which covers the left exhaust muffler 30L from the outside of the vehicle opposite to the rear wheel WR, that is, the left side in the vehicle width direction.

The left outer protector half body 81L has a shape opening toward the rear wheel WR side, and in this embodiment it is formed so as to cover the left exhaust muffler 30L along the entire length thereof in the longitudinal direction from below, above, and the left while having a substantially U-shaped cross-sectional shape opening toward the rear wheel WR side. That is, the left outer protector half body 81L integrally has a flat plate-shaped upper wall portion 81La covering the left exhaust muffler 30L from above, a flat plate-shaped lower wall portion 81Lb covering the left exhaust muffler 30L from below, and a side wall portion 81Lc inclined so as to be closer to the left exhaust muffler 30L in going downward and joining the upper wall portion 81La and the lower wall portion 81Lb on the left side of the left exhaust muffler 30L.

On the other hand, the left inner protector half body 80L has a shape opening toward the side opposite to the rear wheel WR, and in this embodiment it is formed so as to cover a rear part, in the vehicle fore-and-aft direction, of the left exhaust muffler 30L from the right side while having a substantially U-shaped cross-sectional shape opening toward the side opposite to the rear wheel WR. That is, the left inner protector half body 80L integrally has a vertical wall portion 80La extending in the vertical direction on the right side of the rear part of the left exhaust muffler 30L, an upper horizontal wall portion 80Lb extending rightward from the upper end of the vertical wall portion 80La, and a lower horizontal wall portion 80Lc extending rightward from the lower end of the vertical wall portion 80La.

The rear part of the left collecting exhaust pipe cover 39L in the vehicle fore-and-aft direction is formed so as to cover a front part of the left outer protector half body 81L from the outer side, and a first projecting piece 82 fixed to a lower part at the front end of the left exhaust muffler 30L and extending forward is inserted through and retained via a rubber 84 by a first retaining part 83 fixedly provided on an inner face of a lower part of the rear part of the left collecting exhaust pipe cover 39L. A second projecting piece 85 extending forward is projectingly provided on a front end part of the upper wall portion 81La of the left outer protector half body 81L, and the second projecting piece 85 is inserted through and retained via a rubber 87 by a second retaining part 86 fixedly provided on an inner face of an upper part of the rear part of the left collecting exhaust pipe cover 39L.

A first stay 88 to which first and second weld nuts 89 and 90 are fixed is provided on a left upper part of the front part of the left exhaust muffler 30L, a first mounting plate 91 fixed to the inner face of the rear part of the left collecting exhaust pipe cover 39L is fastened to the first stay 88 via a first screw member 92 screwed into the first weld nut 89 and a first mount rubber 93, and a second mounting plate 94 fixed to the inner face of the front part of the side wall portion 81Lc of the left outer protector half body 81L is fastened to the first stay 88 via a second screw member 95 screwed into the second weld nut 90 and a second mount rubber 96.

A second stay 97 to which a third weld nut 98 is fixed is provided on a right upper part of the front part of the left exhaust muffler 30L. On the other hand, a third mounting plate 99 is projectingly provided on the upper wall portion 81La of the left outer protector half body 81L so as to project downward from the right edge of the front end part, and the third mounting plate 99 is fastened to the second stay 97 via a third screw member 100 screwed into the third weld nut 98 and a third mount rubber 101.

That is, the front part of the left outer protector half body 81L is linked to the rear part of the left collecting exhaust pipe cover 39L and fastened to the front part of the left exhaust muffler 30L.

A rectangular mounting hole 103 for mounting a saddle bag guard 102 is formed in a left wall of the rear part of the left collecting exhaust pipe cover 39L, a first support plate 104 having a part thereof projecting from the mounting hole 103 is fixed to the inner face of the rear part of the left collecting exhaust pipe cover 39L, and the saddle bag guard 102 covering the mounting hole 103 is fastened to the first support plate 104.

A third projecting piece 107 projecting rearward is fixed to an upper face of the rear part of the left exhaust muffler 30L, and a fourth projecting piece 108 projecting rearward is fixed to a left face of the rear part of the left exhaust muffler 30L; the third projecting piece 107 is inserted through and retained via a rubber 111 by a third retaining part 109 provided on an inner face of a rear part of the upper wall portion 81La of the left outer protector half body 81L, and the fourth projecting piece 108 is inserted through and retained via a rubber 112 by a fourth retaining part 110 provided on an inner face of a rear part of the side wall portion 81Lc of the left outer protector half body 81L.

Figure 13:
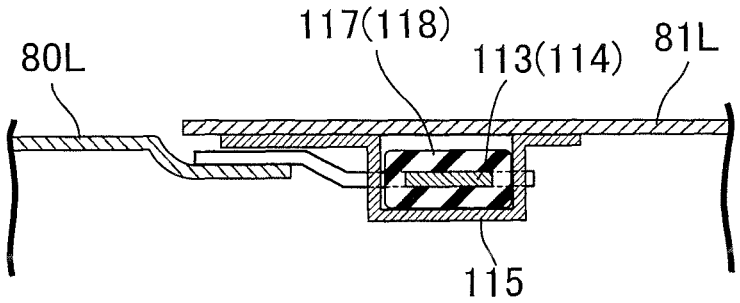
FIG. 13 is a sectional view along line 13-13 in FIG. 11. (first embodiment)
Figure 13:
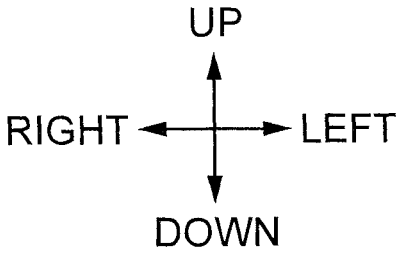

Referring in addition to FIG. 13, fifth and sixth projecting pieces 113 and 114 projecting rearward are fixed to two locations, spaced in the vehicle fore-and-aft direction, of the upper horizontal wall portion 80Lb of the left inner protector half body 80L, and the fifth and sixth projecting pieces 113 and 114 are inserted through and retained via rubbers 117 and 118 by fifth and sixth retaining parts 115 and 116 provided on the inner face of the rear part of the upper wall portion 81La of the left outer protector half body 81L.

Figure 14:
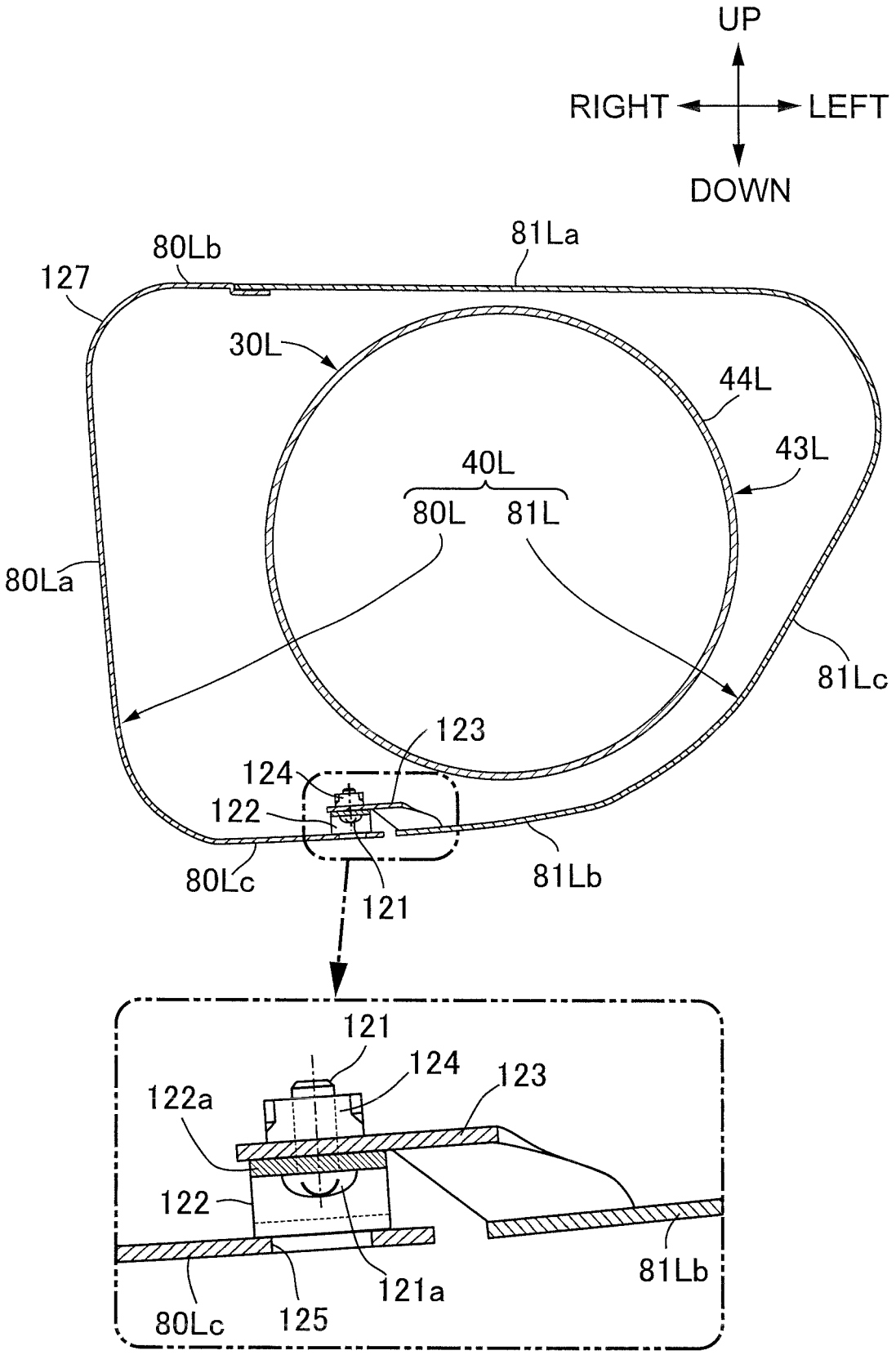
FIG. 14 is a sectional view along line 14-14 in FIG. 11. (first embodiment)

In FIG. 14, a lower part of the left inner protector half body 80L is fixed to a lower part of the left outer protector half body 81L by means of a fourth screw member 121, which is a single fastening member, and a third stay 122 having a mounting portion 122*a* projecting upward from an inner face of the lower horizontal wall portion 80Lc is provided on the lower part of the left inner protector half body 80L, that is, the inner face of the lower horizontal wall portion 80Lc. On the other hand, a second support plate 123 corresponding to the third stay 122 is fixed to the inner face of the rear part of the lower wall portion 81Lb of the left outer protector half body 81L, and a fourth weld nut 124 is fixed to the third support plate 123. Moreover, an opening 125 corresponding to the mounting portion 122*a* is formed in the lower horizontal wall portion 80Lc, the mounting portion 122*a* is fastened to the second support plate 123, that is, the lower part of the left outer protector half body 81L, by means of the fourth screw member 121, which is inserted into the opening 125 and screwed into the fourth weld nut 124, and an enlarged diameter head portion 121*a* of the fourth screw member 121 is housed within the lower part of the left inner protector half body 80L via the opening 125.

As described above the left inner protector half body 80L is detachably mounted on the left outer protector half body 81L mounted on the left exhaust muffler 30L, the left inner protector half body 80L is detachably mounted on the left outer protector half body 81L while maintaining a state in which the left outer protector half body 81L is mounted on the left exhaust muffler 30L, and a cap 126 is fitted onto a rear end part of the left muffler protector 40L.

Moreover, as clearly shown in FIG. 14 the left inner protector half body 80L and the left outer protector half body 81L have a polygonal cross-sectional shape (in this embodiment a quadrilateral shape), and they are combined so that a corner part 127, on the rear wheel WR side, of an upper side of the polygon is formed from the left inner protector half body 80L.

The right muffler protector 40R covering the right exhaust muffler 30R and having its rear end part fitted with the cap 126 is formed from a right inner protector half body 80R covering the right exhaust muffler 30R from the rear wheel WR side, that is, the left side in the vehicle width direction, and a right outer protector half body 81R covering the right exhaust muffler 30R from the side opposite to the rear wheel WR, that is, the right side in the vehicle width direction, and has basically the same structure as that of the left muffler protector 40L described above; parts corresponding to the left muffler protector 40L are denoted by the same reference numerals and symbols and only illustrated, and detailed explanation thereof is omitted.

The operation of the embodiment is now explained; in the left and right exhaust mufflers 30L and 30R, since the downstream end 55*a* of the first communication pipe 55 and the upstream end 57*a* of the first tailpipe 57 are disposed so as to be spaced from each other in the axial direction, one end part of the support member 75 having a circular cross section and a smaller diameter than that of the first communication pipe 55 and the first tailpipe 57 is fixed to one of the first lid member 63 covering the opening of the downstream end 55*a* of the first communication pipe 55 and the second lid member 72 covering the opening of the upstream end 57*a* of the second pipe, and the other end part of the support member 75 is slidably fitted into the other of the first lid member 63 closing the downstream end 55*a* of the first communication pipe 55 and the second lid member 72 closing the upstream end 57*a* of the first tailpipe 57, it is possible to mutually support the first communication pipe 55 and the first tailpipe 57 while allowing extension and shrinkage due to thermal expansion of the first communication pipe 55 and of the first tailpipe 57 by means of a gap between the first communication pipe 55 and the first tailpipe 57, thus making the length of the pipe be unaffected by restrictions and enhancing the degree of freedom in design of the left and right exhaust mufflers 30L and 30R.

Furthermore, since the opposite end parts of the support member 75, which is formed from a cylindrical pipe material, are disposed so as to extend through the first lid member 63 and the second lid member 72, it is possible, by making exhaust gas flow that has been blocked by the first and second lid members 63 and 72 flow via the support member 75, to obtain an effect in preventing the pressure at the downstream end 55*a* of the first communication pipe 55 from increasing excessively.

Moreover, since the support member 75 is disposed coaxially with the first communication pipe 55 and the first tailpipe 57, it is possible to equalize the flow of exhaust gas between the downstream end 55*a* of the first communication pipe 55 and the upstream end 57*a* of the first tailpipe 57, thus making it difficult for local build-up to occur.

Furthermore, since the seventh support tube portion 63*a* is projectingly provided integrally with one of the first lid member 63 and the second lid member 72, in this embodiment the first lid member 63, so as to project toward the side opposite to the second lid member 72, the one end part of the support member 75 extending through the seventh support tube portion 63*a*, and the outer peripheral face of the one end part of the support member 75 is welded via the seventh weld part 71 to the projecting edge of the seventh support tube portion 63*a*, it is possible, by preventing the weld bead of the seventh weld part 71 from decreasing the flow area in the interior of the support member 75, to ensure the flow performance.

Moreover, since the external diameter of the first tailpipe 57 is set to be smaller than the external diameter of the first communication pipe 55, it is possible, by making the thermal expansion characteristics of the first communication pipe 55 and of the first tailpipe 57 be different from each other, to prevent interference occurring therebetween due to the thermal expansions amplifying each other under the same conditions.

Furthermore, since the first tailpipe 57 extends through the rear end wall 46 of the casing 43L and is fixed to the rear end wall 46, and one end part of the support member 75 is fixed to the first lid member 63, even if a force due to frictional resistance between the second lid member 72 and the support member 75 slidably supported on the second lid member 72 is applied to the first tailpipe 57, it is possible to prevent there being a large influence on the parts via which the first tailpipe 57 and the casings 43L and 43R are joined.

Moreover, since the plurality of third punched holes 65 are formed in the side wall at least on the downstream side of the first communication pipe 55, it is possible to diffuse exhaust gas that has been blocked by the first lid member 63 into the third expansion chamber 53 via the third punched holes 65, thus reducing the exhaust gas pressure, decreasing the exhaust energy, and enhancing the muffling effect.

Furthermore, in the right exhaust muffler 30R, since the recess part 78, which is recessed toward the side away from the rear wheel WR, is formed in the side wall, facing the rear wheel WR side, of the front part of the casing 43R in the vehicle fore-and-aft direction, and the upstream end of the first communication pipe 55 extending through the first and second partition walls 49R and 50 disposed so as to be spaced in the vehicle fore-and-aft direction is disposed within the casing 43R in a portion corresponding to the recess part 78, although placement of the pipe is restricted due to formation of the recess part 78 for avoiding interference with peripheral equipment of the rear wheel WR, it is possible, by using effectively the first communication pipe 55, which has a long pipe length, to ensure the function of the right exhaust muffler 30R.

Moreover, since the left and right exhaust mufflers 30L and 30R disposed on the outer side of the rear wheel WR so as to overlap the rear wheel WR when viewed from the side are covered by the left and right muffler protectors 40L and 40R mounted on the exhaust mufflers 30L and 30R, the left and right muffler protectors 40L and 40R are formed from the left and right inner protector half bodies 80L and 80R covering the left and right exhaust mufflers 30L and 30R from the rear wheel WR side and the left and right outer protector half bodies 81L and 81R covering the left and right exhaust mufflers 30L and 30R from the vehicle outer side opposite to the rear wheel WR, and the left and right inner protector half bodies 80L and 80R are detachably mounted on the left and right exhaust mufflers 30L and 30R or the left and right outer protector half bodies 81L and 81R (in this embodiment the left and right outer protector half bodies 81L and 81R) while maintaining a state in which the left and right outer protector half bodies 81L and 81R are mounted on the left and right exhaust mufflers 30L and 30R, although the overall dimensions of the left and right exhaust mufflers 30L and 30R, including the left and right muffler protectors 40L and 40R, are large, it is possible to carry out maintenance by detaching only the left and right inner protector half bodies 80L and 80R, and maintenance can be carried out without temporarily detaching the left and right exhaust mufflers 30L and 30R each time maintenance is carried out while avoiding any influence on the bank angle by making it unnecessary to dispose the left and right exhaust mufflers 30L and 30R at positions away from the rear wheel WR on the outer side in the vehicle width direction, thus enhancing the ease of maintenance.

Furthermore, since the left and right outer protector half bodies 81L and 81R are formed so as to cover the entire length of the left and right exhaust mufflers 30L and 30R in the longitudinal direction, and the left and right inner protector half bodies 80L and 80R are formed so as to cover the rear parts, in the vehicle fore-and-aft direction, of the left and right exhaust mufflers 30L and 30R, it is possible to avoid any degradation of the appearance when viewed from the side opposite to the left and right exhaust mufflers 30L and 30R with respect to the rear wheel WR while minimizing the dimensions of the left and right inner protector half bodies 80L and 80R forming part of the left and right muffler protectors 40L and 40R.

Moreover, since the left and right outer protector half bodies 81L and 81R forming a shape opening toward the rear wheel WR side (in this embodiment a shape having a substantially U-shaped cross section opening toward the rear wheel WR side) and the left and right inner protector half bodies 80L and 80R forming a shape opening toward the side opposite to the rear wheel WR (in this embodiment a shape having a substantially U-shaped cross section opening toward the side opposite to the rear wheel WR) are combined so that the cross-sectional shape is a polygonal (in this embodiment a quadrilateral shape) and the corner part 127, on the rear wheel WR side, of the upper side is formed by the left and right inner protector half bodies 80L and 80R, the area that can be accessed from above the left and right exhaust mufflers 30L and 30R is widened when only the left and right inner protector half bodies 80L and 80R are detached, further enhancing the ease of maintenance.

Furthermore, since the left and right exhaust mufflers 30L and 30R covered by the left and right muffler protectors 40L and 40R are disposed on opposite sides in the vehicle width direction of the rear wheel WR, when carrying out maintenance of different parts from opposite sides of the rear wheel WR, it is unnecessary to temporarily detach the left and right exhaust mufflers 30L and 30R on the opposite sides, and maintenance can be carried out by detaching only the left and right inner protector half bodies 80L and 80R, thus enhancing the ease of maintenance.

Moreover, since the left and right inner protector half bodies 80L and 80R are detachably mounted on the left and right outer protector half bodies 81L and 81R mounted on the left and right exhaust mufflers 30L and 30R, it is difficult for heat to be transferred from the left and right exhaust mufflers 30L and 30R to the left and right inner protector half bodies 80L and 80R, and the time waiting for the temperature of the left and right inner protector half bodies 80L and 80R to decrease when carrying out maintenance can be shortened.

Furthermore, since the fifth and sixth projecting pieces 113 and 114 fixed to the left and right inner protector half bodies 80L and 80R are inserted into and retained via the rubbers 117 and 118 respectively by the fifth and sixth retaining parts 115 and 116 provided on the reverse faces of the left and right outer protector half bodies 81L and 81R, it is possible, by preventing the structure via which the left and right inner protector half bodies 80L and 80R are retained by the left and right outer protector half bodies 81L and 81R from being exposed to the outside, to avoid any degradation in the appearance of the left and right muffler protectors 40L and 40R.

Moreover, since the lower parts of the left and right inner protector half bodies 80L and 80R are fixed to the lower parts of the left and right outer protector half bodies 81L and 81R by means of the single fourth screw member 121, it is possible to strongly fix the left and right inner protector half bodies 80L and 80R to the left and right outer protector half bodies 81L and 81R at locations that are inconspicuous.

Furthermore, since the third stay 122 having the mounting portion 122*a* projecting upward from the inner face of the lower part of the left and right inner protector half bodies 80L and 80R is provided on the lower part of the inner protector half bodies 80L and 80R, the opening 125 corresponding to the mounting portion 122*a* is formed in the lower parts, and the mounting portion 122*a* is fastened to the lower part of the left and right outer protector half bodies 81L and 81R by means of the fourth screw member 121 inserted into the opening 125, it is possible to make it difficult for the fourth screw member 121 to be seen from the side of the left and right muffler protectors 40L and 40R, thus improving the appearance.

An embodiment of the present invention is explained above, but the present invention is not limited to the above embodiment and may be modified in a variety of ways as long as the modifications do not depart from the spirit and scope thereof.

For example, in the above embodiment the left and right exhaust mufflers 30L and 30R disposed on the left and right sides of the rear wheel WR of a two-wheeled motor vehicle are explained, but the present invention can be applied to an exhaust muffler disposed on one of the left and right sides of a rear wheel, and can be applied to an exhaust muffler of an internal combustion engine mounted on a vehicle other than a two-wheeled motor vehicle.

The invention claimed is:

1. An exhaust muffler for installation on a vehicle having a rear wheel and having a vehicle fore-and-aft direction, said exhaust muffler comprising:

a casing, a plurality of partition walls that are fixed to the casing and spaced apart from one another in the vehicle fore-and-aft direction, the partition walls operable to partition an interior of the casing into a plurality of expansion chambers, and a plurality of pipes that extend through either the casing or the partition walls so as to make exhaust gas flow therethrough, wherein:

among the pipes, first and second pipes are disposed so that a downstream end, along a flow direction of exhaust gas of the first pipe, coaxially faces an upstream end of a flow direction of exhaust gas of the second pipe, the first pipe extends through the plurality of partition walls, the downstream end of the first pipe and the upstream end of the second pipe are disposed so as to be spaced from each other in an axial direction, and are interconnected by a support member having a circular cross section that has a smaller diameter than diameters of the first and second pipes, one end part of the support member is fixed to one of a first lid member, covering an opening at the downstream end of the first pip; and a second lid member covering an opening at the upstream end of the second pipe, and the other end part of the support member is slidably fitted to the other of the first and the second lid members, a recess part, configured to be disposed adjacent and recessed away from the rear wheel when the muffler is installed on the vehicle, is formed in a side wall of the casing, and an upstream end of the first pipe is disposed within the casing in a portion thereof corresponding to the recess part.

2. The exhaust muffler according to claim 1, wherein opposite end parts of the support member, which is formed from a cylindrical pipe material, are disposed so as to extend through the first lid member and the second lid member.

3. The exhaust muffler according to claim 2, wherein the support member is disposed coaxially with the first pipe and the second pipe.

4. The exhaust muffler according to claim 2, wherein a support tube portion is projectingly provided integrally with one of the first lid member and the second lid member so as to project toward a side opposite to the other of the first lid member and the second lid member, said one end part of the support member extending through the support tube portion, and an outer peripheral face of said one end part of the support member is welded to a projecting edge of the support tube portion.

5. The exhaust muffler according to claim 1, wherein an external diameter of the second pipe is set to be smaller than an external diameter of the first pipe.

6. The exhaust muffler according to claim 1, wherein the second pipe is a tailpipe that extends through the casing and is fixed to the casing, and one end part of the support member is fixed to the first lid member.

7. The exhaust muffler according to claim 1, wherein a plurality of punched holes are formed in a side wall, at least on the downstream side, of the first pipe.

8. The exhaust muffler according to claim 3, wherein a support tube portion is projectingly provided integrally with one of the first lid member and the second lid member so as to project toward a side opposite to the other of the first lid member and the second lid member, said one end part of the support member extending through the support tube portion, and an outer peripheral face of said one end part of the support member is welded to a projecting edge of the support tube portion.

* * * * *